United States Patent [19]

Schmoll et al.

[11] Patent Number: 4,796,456

[45] Date of Patent: Jan. 10, 1989

[54] FORGING MACHINE

[75] Inventors: Heinz Schmoll; Peter Schubert, both of Kaarst; Hans A. Schubert, Düsseldorf; Klaus Schulze, Mönchengladbach; Heinrich Kutz, Neuss, all of Fed. Rep. of Germany

[73] Assignee: SMS Hasenclever Maschinenfabrik GmbH, Düsseldorf, Fed. Rep. of Germany

[21] Appl. No.: 947,331

[22] Filed: Dec. 29, 1986

[30] Foreign Application Priority Data

| | | | |
|---|---|---|---|
| Jan. 2, 1986 | [DE] | Fed. Rep. of Germany | 3600018 |
| Jan. 7, 1986 | [DE] | Fed. Rep. of Germany | 3600178 |
| Jan. 13, 1986 | [DE] | Fed. Rep. of Germany | 3600690 |
| Aug. 16, 1986 | [DE] | Fed. Rep. of Germany | 3627843 |
| Sep. 4, 1986 | [DE] | Fed. Rep. of Germany | 3630170 |
| Sep. 16, 1986 | [DE] | Fed. Rep. of Germany | 3631439 |

[51] Int. Cl.[4] ..... B21J 7/02

[52] U.S. Cl. ..... 72/402; 72/446; 72/447; 72/453.01

[58] Field of Search ..... 72/402, 407, 399, 447, 72/76, 453.01, 446; 100/264, 226, 257

[56] References Cited

U.S. PATENT DOCUMENTS

| | | | |
|---|---|---|---|
| 3,478,565 | 11/1969 | Schenk et al. | 72/399 |
| 3,613,432 | 10/1971 | Schenk et al. | 72/402 |
| 3,656,334 | 4/1972 | Schenk et al. | 72/399 |
| 3,657,916 | 4/1972 | Pahnke | 72/447 |
| 3,841,143 | 10/1974 | Harada et al. | 72/453.01 |
| 3,929,000 | 12/1975 | Kralowetz | 72/402 |

FOREIGN PATENT DOCUMENTS

| | | | |
|---|---|---|---|
| 555710 | 2/1960 | Belgium | 72/402 |
| 325985 | 9/1920 | Fed. Rep. of Germany | 72/402 |
| 449558 | 9/1927 | Fed. Rep. of Germany . | |
| 1094075 | 12/1960 | Fed. Rep. of Germany | 72/402 |
| PA64549 | 1/1967 | Fed. Rep. of Germany . | |
| 1271513 | 6/1968 | Fed. Rep. of Germany . | |
| 1301790 | 8/1969 | Fed. Rep. of Germany . | |
| 810337 | 3/1959 | United Kingdom | 72/402 |

OTHER PUBLICATIONS

Universitat Stuttgart-IFU-55-Peter Metzger, No. 621.974.8; 1980, pp. 36-39, 68, 69, 112, 113, 128, 129.

*Primary Examiner*—Daniel C. Crane

*Attorney, Agent, or Firm*—Holman & Stern

[57] ABSTRACT

In a forging machine which has four radial rams with respective tools together forming a closed bite, each tool overlaps one adjacent tool and is overlapped by the other adjacent tool, and can be adjusted laterally relative to the radial ram axis, in the operating plane of the rams and tools, for setting the bite size.

23 Claims, 12 Drawing Sheets

FIG.1
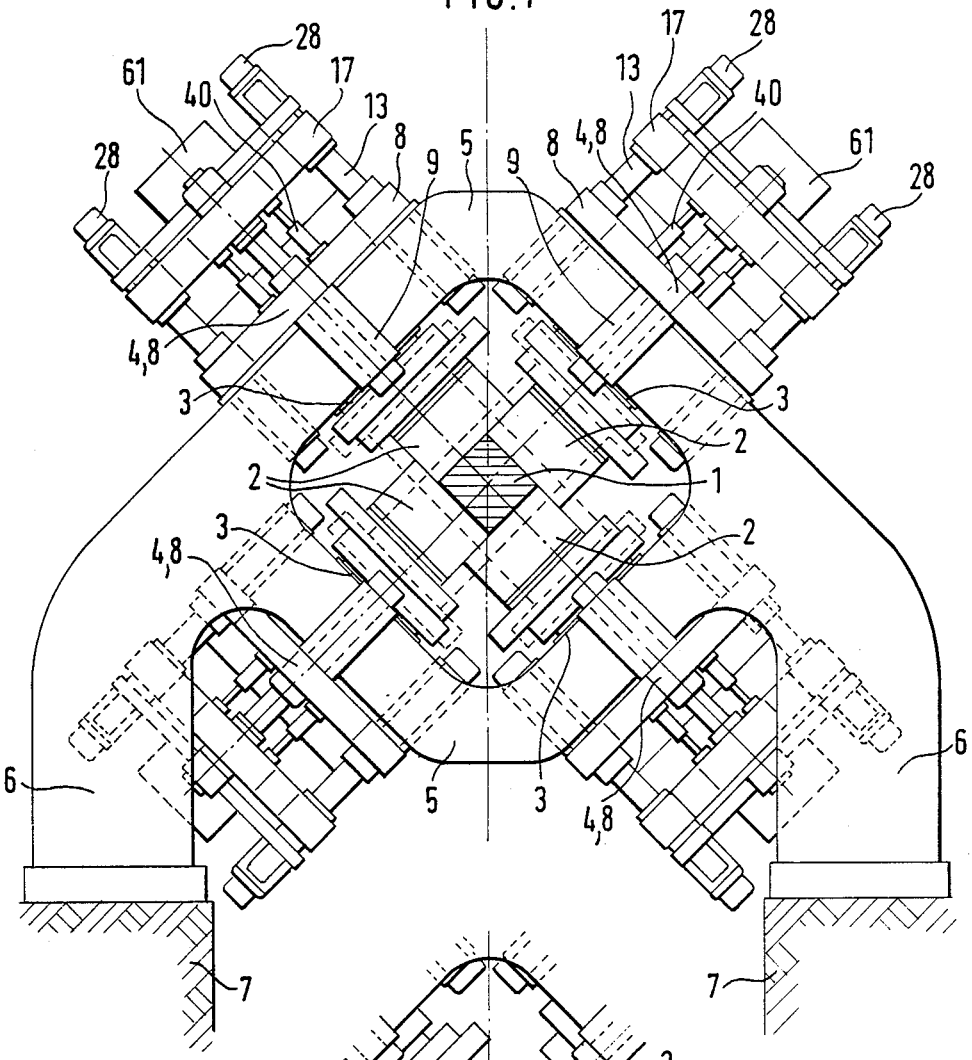
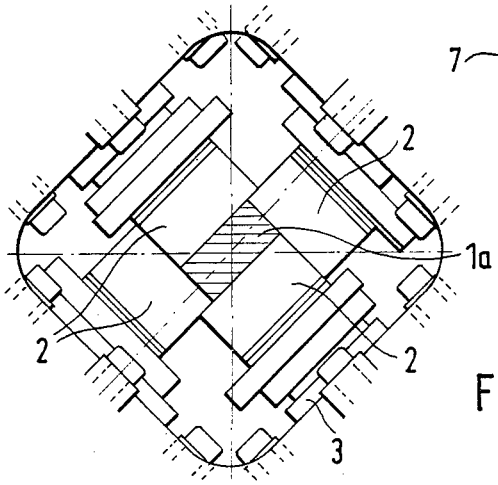
FIG.1a

FORGING MACHINE

BACKGROUND OF THE INVENTION

Forging machines are used for forging workpieces having a distinct longitudinal axis and a circular, square, rectangular or similar cross-section, and are provided with rams, usually four in number, which act on the workpiece radially and simultaneously and are fitted with tools. The tools, whose action is distributed around the workpiece and which usually form an enclosed space or opening for the workpiece in their inner stroke end position, permit spread-free deformation with correspondingly thorough forging. Economical use of these forging machines demands a high degree of flexibility, and for this reason the workpieces are basically produced with no connection of shape between the tool and workpiece and without a change of tool. Tools with a flat working surface are therefore used. The resulting cross-section, being enclosed by the tools in the stroke end position, has sides whose length corresponds to the tool width. Smaller enclosed cross-sections cannot be forged, the larger enclosed cross-sections can be forged only in an open calibre and therefore not completely.

To overcome this disadvantage, tools have been used which have a plurality of projecting working surfaces in the longitudinal direction of the workpiece, and which engage in gaps in adjacent tools in the manner of a comb (German Patent Publication AS No. 10 94 075). The minimum enclosed cross-section can differ from the maximum enclosed cross-section in the length of side by double the gap depth, with the workpiece space closed. This advantage, however, is attained at the expense of interruption of the flat working surfaces of the tools, and material is expelled into the gaps, to a greater degree, the greater is the deformation per stroke. For this reason such tools are used only for short-stroke forging machines, that is, machines which operate more by hammering than by pressing. Even when the gaps are only in the marginal areas of the tools, so that the tools have a continuous working surface in the region of the breadth of the smallest enclosed cross-section, there is still the disadvantage that undesirable markings or deformations occur in the marginal area on the larger cross-sections.

It is also known for the tools to be so arranged that the lateral surface of a tool bears on the working surface of the adjacent tool, so that the tools together form a closed calibre in any position. A prerequisite for this arrangement of tools is that the ram axes are parallel to the cross-section diagonals and the working surface of the tools is oblique relative to the ram axis (German Pat. No. 449 558, German Patent Application OS No. 19 53 123), or that, with ram axes approximately perpendicular to the working surfaces of the tools, the tools, which are guided by rods, and the ram and cylinder units must be pivotably connected to the machine frame and tools (German Utility Model 19 53 867, corresponding to U.S. Pat. No. 3,478,565). The required construction outlay, undesirable stressing of the components, wear-prone guides and in particular relative sliding of the tools and workpiece due to the oblique or oscillatory motion of the tools are serious drawbacks of forging machines of the type described above.

BRIEF SUMMARY OF THE INVENTION

The invention is a forging machine with four rams which are arranged in the form of a cross in an operating plane perpendicular to the longitudinal axis of the workpiece and are movable transversely relative to this axis, and which are movable themselves as part of a piston/cylinder unit or by a drive unit, more particularly a piston/cylinder unit, and are operatively connected to tools which form a closed workpiece space in the stroke end position nearer the center, each tool being, with the unused width of its working surface, overlapped by one lateral surface of one of the adjacent tools, and overlapping in turn with one of its lateral surfaces the unused width of the working surface of the other adjacent tool.

An object of the invention is to avoid oblique or oscillatory movements of the tools and the resulting relative sliding of the tools and workpiece.

According to a preferred embodiment of the invention, the drive units are arranged in a known manner to act radially relative to the longitudinal axis of the workpiece; setting means are provided for setting and indicating the stroke end position; and each tool is adjustable, in a support formed by the ram and a cross element, by means of a setting device according to the stroke end position setting which determines the forging dimension, this adjustment of the tool being in the operating plane away from the operating axis of the drive unit by an amount equal to half the difference between the total width and the operative width (for the current calibre) of the tool.

The invention does not require or provide for a workpiece space closed in all stroke positions, since it has proved adequate for the space to be closed only in the stroke end position corresponding to the current forging dimension, and this can be achieved according to the invention through lateral adjustability of the tools relative to the drive units.

Irrespective of whether the piston/cylinder units are used only as drive units for separate rams or the rams themselves form parts of the piston/cylinder units, it is an advantage to dimension the piston/cylinder units only for the working stroke, and to adjust the stroke position by special mechanical setting means, as is done to minimize the volume of oil acting in the hydraulic drive and affecting the dynamic behaviour of the forging machine.

Within the space of the invention idea there are various possible embodiments, which should be judged particularly according to whether they permit rapid adjustment of the tools and their supports to the desired workpiece space, that is, adjustment without extended interruption of the forging process, this being another object of the invention.

To achieve this object, according to another feature of the invention, cross elements fitted with the tools are guided in head members of the rams so as to be adjustable in the operating plane perpendicularly to the ram axis and can be fixed by releasable clamping elements relative to the head members, whereas setting devices for moving the cross elements in the head members on release of the clamping elements are arranged to act between the head members and cross elements.

Advantageously, the drive and/or indicating devices for the setting devices are mounted on the ram ends remote from the head members, and are connected by couplers to the setting devices, the couplers passing through or being parallel to the rams.

A compact arrangement is obtained if the rams form parts (pistons or cylinders) of piston/cylinder ram drive units. If the rams are in the form of pistons, it is advantageous if the cylinders are connected to the machine frame to guide the pistons directly, and if the stroke position is adjusted by means of plugs adjustable in the cylinders and forming their ends. If, however, the rams are in the form of cylinders, which are therefore movably guided in the machine frame, the pistons should be designed for stroke position adjustment, by mounting them adjustably in the machine frame. Rams in piston form may have shanks passing through the plugs; similarly, rams in cylinder form may have shanks passing through the pistons, which are hollow. These shanks may be designed for stroke limitation and for retraction of the pistons or cylinders (rams) and may also contain axial bores, so that, according to another feature of the invention, they can receive the couplers for providing a driving connection between the setting devices and their driving and/or indicating devices.

According to a further feature of the invention, the setting devices may comprise racks connected to the cross elements and pinions engaging in the racks, and as couplers there may be shafts connected to the pinions and running through the central bores in the rams or along the sides of the rams.

A precondition of reliable operation is that unintended motion of the cross elements relative to the ram heads is prevented. To ensure this, according to another feature of the invention, the ram head and cross element have fine, mutually engaging teeth. This makes infinitely variable adjustment impossible, but the graduated adjustment offered by the fine teeth meets practical needs. In a very simple embodiment, ram heads and cross elements are provided with corresponding grooves and with bars placed in the grooves and bearing the teeth.

The clamping elements for holding the cross elements relative to the ram heads may be constructed in a known manner (see, for example, German Utility Model 7807825, German Patent Application No. 29 05 623) by providing clamping pins which have collars gripping a cross element, a ram head and a spring, of which one collar, in the form of a piston situated above the spring, can be pressurized contrary to the force of the spring, with the feature that the pressurizing of the pistons and release of the clamping elements can simultaneously effect release of the drives for moving the cross elements relative to the ram heads and for adjusting the stroke position.

To ensure satisfactory, secure clamping between the cross elements and the ram heads, according to another feature of the invention, the release of the clamping elements causes a valve to open, which allows compressed air through the resulting gaps between the cross elements and ram heads. The stream of compressed air prevents dirt from entering the gaps.

In another solution to the secondary object of the invention, the cross elements are adjustably guided in the machine frame in the working plane perpendicularly to the ram axis and can be fixed relative to the machine frame by releasable clamping elements; the setting devices for moving the cross elements in the machine frame on release of the clamping devices are arranged to act between the machine frame and the cross elements; and the rams fitted with the tools are axially movable in the cross elements and connected to respective drive units.

If the cross elements are adjustable in the machine frame and the rams are guided for axial movement in the cross elements, according to a further feature of the invention, in the case of piston/cylinder units disposed radially relative to the longitudinal axis of the workpiece to drive the rams, of which the cylinders are mounted static in the machine frame, the pistons are connected to the rams by adjustment of the cross elements with couplings which balance the rams but which transmit the axial forces from the pistons to the rams. A simple and reliable coupling between piston and ram consists, according to another feature of the invention, of a T- or dovetail groove in the end face of the ram, T- or dovetail slides running therein and tie rods which are connected to the slides and are to be tensioned by way of yoke members by pistons running in cylinder bores in the transverse member, the pressurizing of the pistons being interrupted during movement of the cross elements by the setting devices, so that the couplings are released.

A hydraulic drive for the rams by means of piston/-cylinder units, dimensioned only for the working stroke, in conjunction with mechanical adjusting means, more particularly threaded drives, for the stroke position adjustment, has, besides the known advantage of minimizing the compression volumes in the piston/cylinder units, the further advantage that, together with mechanical limitation of the working stroke, the mechanical definition of the stroke position and consequently also of the stroke end position and the setting of the tools by way of the cross elements can be adjusted precisely to one another, as provided according to another feature of the invention.

Automation of the forging sequence is possible if, according to a further feature of the invention, the lateral movements of the cross elements relative to the ram heads or machine frame and the stroke end positions of the rams are measured, and can be adjusted according to a workpiece space dimension currently preset or programmed by way of process control computers.

BRIEF DESCRIPTION OF THE DRAWINGS

The invention will now be described in detail with reference to the accompanying drawings which illustrate embodiments of the invention by way of example wherein:

FIG. 1 is a general elevational view illustrating a first embodiment of the invention, as seen along the longitudinal axis of the workpiece;

FIG. 1*a* is a detail from FIG. 1, showing another tool setting;

DESCRIPTION OF PREFERRED EMBODIMENTS

Figure 2:
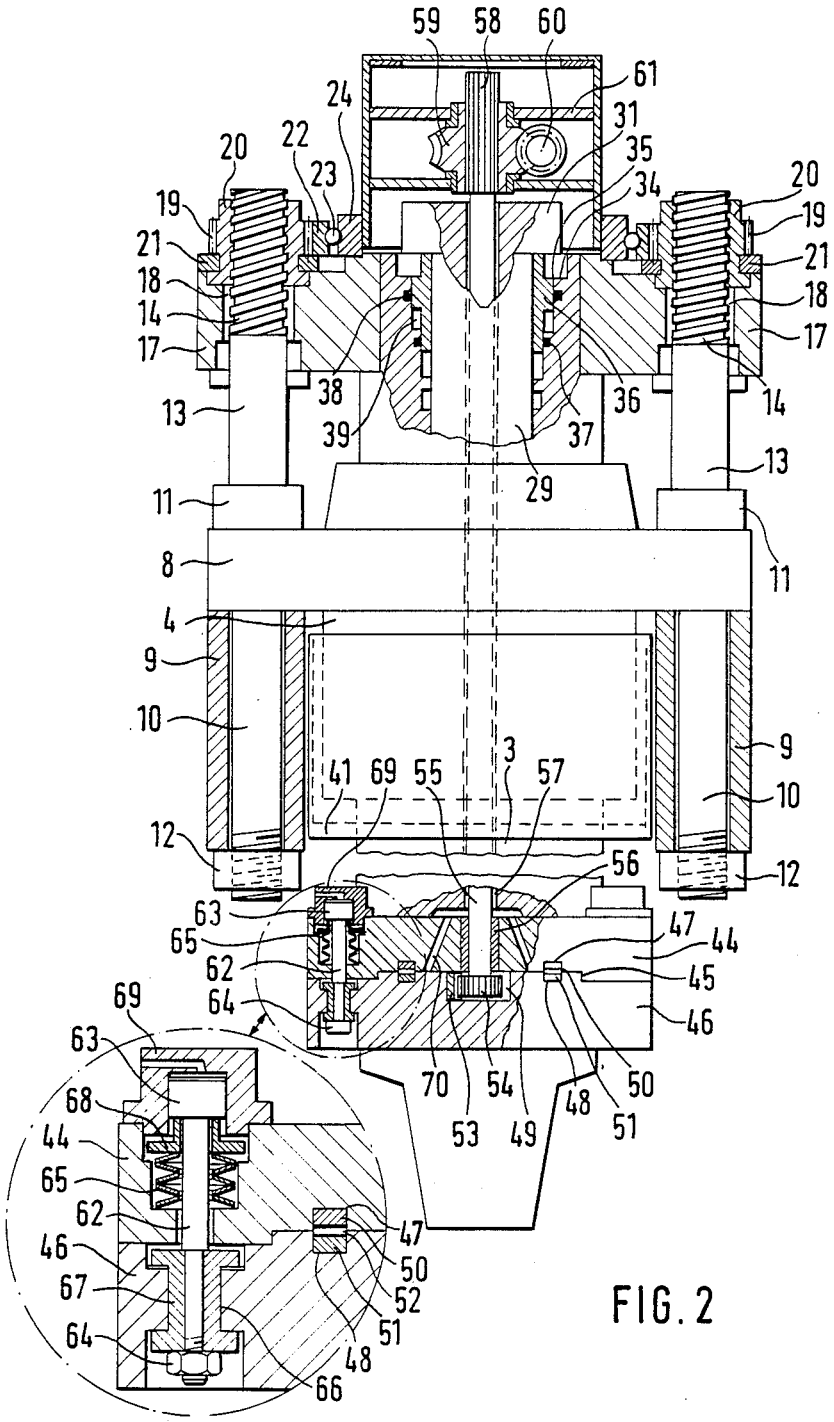
FIG. 2 is a cross-sectional view taken along line A—A in FIG. 5.

FIG. 1 shows in cross-section the workpiece 1, which passes lengthways through the forging machine and is meanwhile extended by the tools 2. The tools 2 are arranged in the manner of a cross closure, that is, they are off-center relative to the cross-section to be forged and are arranged around the workpiece 1 with each of their working surfaces overlapping an adjacent tool 2. The offset of the tools 2 from the center determines the closest possible approach of the tools 2 and therefore the minimum cross-section to be forged with a given tool setting, and this cross-section in turn defines the internal reversal points for the stroke of the tools 2, that is, the stroke end positions for the current stroke position. If all the tools 2 are off-center to the same degree and their stroke end positions are similarly set, the resulting workpiece space is square and centered on the longitudinal axis of the workpiece, as FIG. 1 shows. If the pairs of opposite tools 2 are set with different offsets, the resulting workpiece space is rectangular, as shown in FIG. 1*a*. Alternatively, it is possible, by setting different stroke end positions for opposite tools 2, to form a workpiece space which is off-center relative to the longitudinal axis of the workpiece, as may be desirable, for example, when forging workpieces of which portions of the cross-section are offset parallel to the axis (cranks, cams).

The tools 2 are carried by rams 3 in the form of pistons movable in cylinders 4. Corresponding to the cross-shaped arrangement of the rams or pistons 3 in a plane in which they are offset by 90° relative to one another and are movable radially relative to the longitudinal axis of the workpiece, four cylinders 4 are arranged in a frame 5. Feet 6 anchor the frame 5 to the foundation 7.

The ram drive units formed by the rams or pistons 3 and cylinders 4 are illustrated in detail in FIGS. 2 to 5.

To connect them to the frame 5, the cylinders 4 are provided with flanges 8, and the frame 5 is provided with four eyes 9 for each cylinders 4. Tie rods 10, which extend through bores in the flanges 8 of the cylinders 4 and the eyes 9 of the frame 5, bear by way of collars 11 on the flanges 8, while nuts 12 clamp the flanges 8 and thus the cylinders 4 onto the frame 5. The tie rods 10 are extended to form spindles 13 with threaded shanks 14.

Each cylinder 4 has a through bore which is closed at one end by a plug 15, provided with a seal 16. The plug 15 is rigidly connected to a yoke plate 17, which is provided with four bores 18 for the passage of the spindles 13 of the tie rods 10. The bores 18 are extended to form bearing bores, in which nuts 20 provided with external teeth 19 and internal threads are rotatably mounted and held by a split bearing plate 21. The four nuts 20 for one yoke plate 17 are turned together by a ring gear 22, which is rotatable with balls 23 on a bearing race 24 centered on and fixed to the yoke plate 17. Two of the nuts 20 are extended by sleeve-like projections 25, which leave space internally for the threaded shanks 14 and are provided on their ends with coupling teeth 26. Teeth 26 are in engagement with coupling plates 27 on the output side of drives 28, which can rotate and hold the nuts 20 with the sleeve projections 25 directly and the other two nuts 20 indirectly, by way of the ring gear 22 and pinion 19. On rotation of the nuts 20, these move along the threaded shanks 14 on the spindles 13 and, by way of the yoke plate 17, adjust the plug 15 in the bore in the cylinder 4 in the axial direction.

In each cylinder 4 a piston 3, forming a ram bearing the tool 2, is axially movable. The piston 3 is provided with a round shank 29 and, at the transition between the piston 3 and shank 29, with a square portion 30. In addition the shank 29 is provided at the end with a cap 31. The plug 15 has a corresponding round and, in its portion 30, square bore, the square portion 30 guiding the piston 3 in the corresponding square bore in the plug 15 so that it cannot rotate. The pressure medium space in the cylinder 4 between the piston 3 and plug 15 is sealed off by seals 32, 33. Stops for the axial motion of the piston 3 are provided on the one hand by its abutment on the plug 15 and on the other by the cap 31 on the piston shank 29, the cap 31 abutting on the rear end face 34 of the plug 15. If necessary, the cap 31 may be axially movable on the piston shank 29, so that the stroke of the piston 3 as defined by the stops is also adjustable.

The stroke position of the piston 3, on the other hand, can be set by means of the above-mentioned adjustment of the yoke plate 17, by rotation of the nuts 20 on the threaded shanks 14 of the spindles 13. For retraction of the pistons 3, the plug 15 is bored out from its rear end face to make a cylinder chamber 35. Inside this cylinder chamber 35 an annular piston 36, mounted on the shank 29 of the piston 3 and abutting on the cap 31, co-operates with seals 37, 38 to seal off an annular chamber 39, pressurizing of which causes the piston 3 to return.

Figure 4:
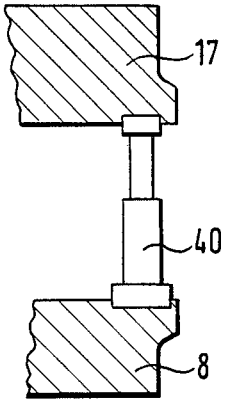
FIG. 4 shows a cross-sectional view taken on line C—C in FIG. 5.
Figure 5:
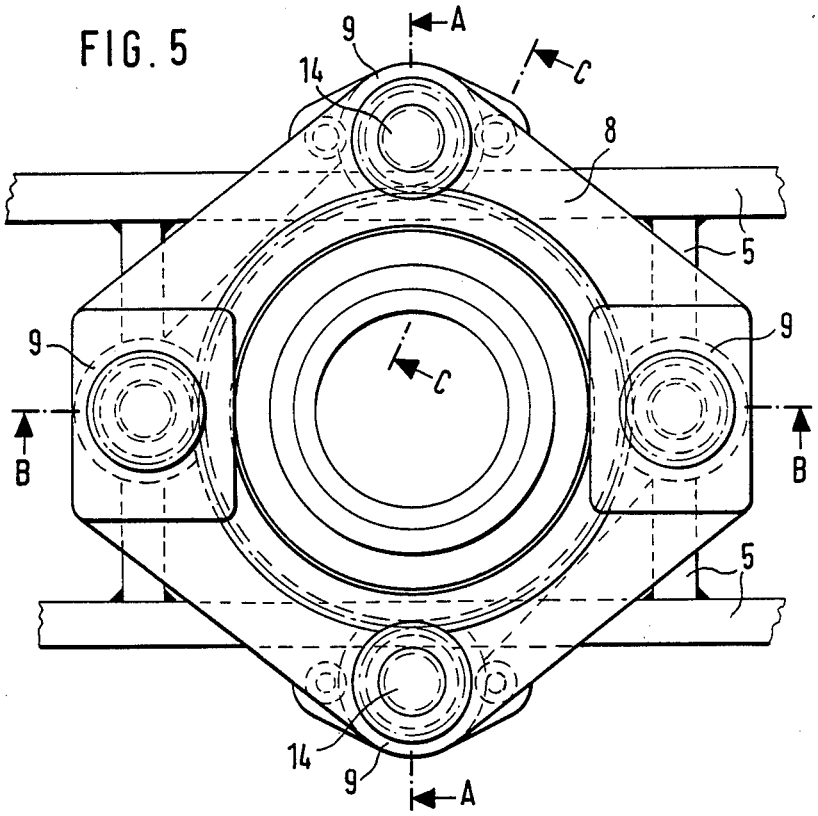
FIG. 5 is a plan view of one of the four piston/cylinder units guiding a ram with a tool.

As best shown in FIG. 4, piston/cylinder units 40 between the flange 8 of the cylinder 4 and the yoke plate 17 maintain constant abutment of the threaded nuts 20 on the threaded shank 14 in the direction of the working pressure, to ensure play-free support for the plug 15.

Figure 3:
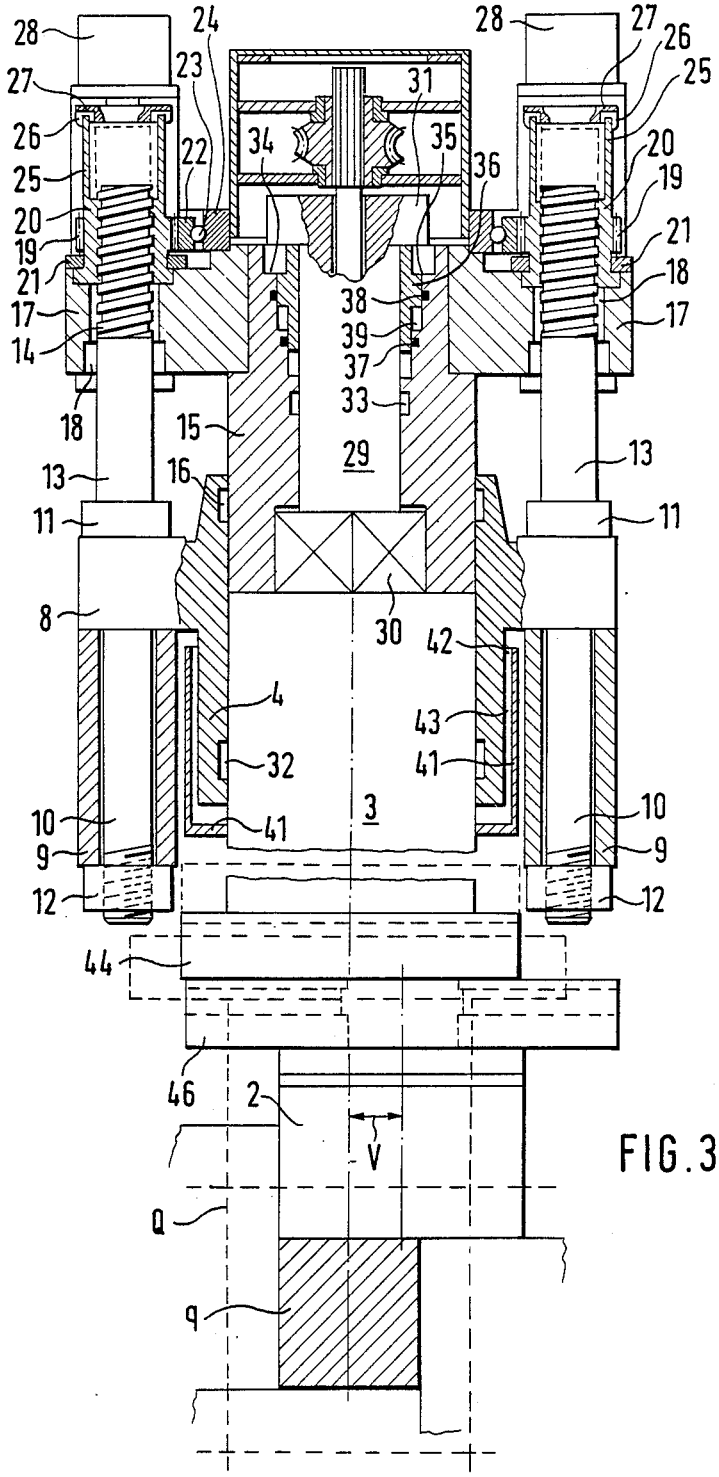
FIG. 3 shows a cross-sectional view taken along line B—B in FIG. 5.

To prevent contamination of the piston 3 where it projects from the cylinder 4 by scale, water splashes or the like, the piston 3 carries a protective cover 41 which surrounds the outside of the cylinder 4 with slight clearance (FIG. 3). Compressed air is blown into the protective cover 41 and comes out of the annular gap 42 between the cover 41 and cylinder 4, so preventing dirt from penetrating into the space 43 covered by the cover 41.

As FIGS. 1 to 3 show, each ram or piston 3 is connected at its inner or head end to a ram head 44. Every ram head 44 contains a guide groove 45 in which a cross element 46 is slidable in the operating plane perpendicular to the longitudinal axis of the workpiece. The rams 3 and their ram heads 44, together with the cross elements 46, form supports for the tools 2. Parallel to the guide groove 45, the ram head 44 contains two further grooves 47 and, in register with these, the cross element 44 contains two grooves 48 and a groove 49. The grooves 47 contain bars 50 connected to the ram head 44, and the grooves 48 contain bars 15 connected to the cross element 46, the bars 50 and 51 being provided on their mutually facing surfaces with fine teeth 52 engaging one another. A rack 53 is placed and held in the groove 49 along one side of the groove. This rack 53 is engaged by a pinion 54 connected to one end of a shaft 55. The shaft 55 is rotatably mounted in a bearing bushing 56 in the ram head 44, extends through the ram or piston 3 and piston shank 29 in an axial bore 57, and is provided at its other end with splines 58, by which it engages in a correspondingly toothed bore in a worm wheel 59 in such a way that it is constrained in respect of rotation but is axially movable. The worm wheel 59 and an associated worm shaft 60 are mounted in a drive housing 61 connected to the yoke plate 17 and can be driven by a drive (not shown).

To connect the ram head 44 to the cross element 46, clamping elements are provided, comprising a clamping pin 62 and, as collars for the clamping pin 62, a piston 63 and nut 64; these collars grip the ram head 44, the cross element 46 and a spring 65. The cross element 46, which is movable relative to the ram head 44, is provided in the direction of motion with slots 66, in which two-part clamping blocks 67 are movable. The springs 65, formed of a stack of plate springs or Belloville springs and supported in the ram head 44, bear by way of flanged sleeves 68 on the pistons 63 of the clamping pins 62, so that the ram head 44 and cross element 46 are clamped relative to one another by way of the nuts 64 and clamped blocks 67. By pressurizing the pistons 63 in cylinders 69 connected to the ram head 44, the cross element 46 can be pushed away from the ram head 44 by the clamping pins 62 by way of the clamping blocks 67, until the teeth 52 on the pairs of bars 50, 51 disengage, whereas the cross element 46 continues to be guided in the guide groove 46, the groove 45 being made correspondingly deeper than the teeth 52. To maintain engagement of the cross element 46 in the groove 45, the flanged sleeves 68 find a corresponding stroke limitation in the stepped bores receiving the spring stacks 65. The cross element 46 can then be adjusted relative to the ram head 44 by means of a drive by way of the worm shaft 60, worm wheel 59, shaft 55, pinion 54 and rack 53. Pressurizing of the pistons 63 causes a valve (not shown) to open, through which compressed air enters the closed drive housing 61 and so passes through the bore 57 and bores 70 into the gap which forms between the ram head 44 and the stepped cross element 46. There the air is expelled, so preventing dirt (scale or the like) for entering the gap.

Tools 2 are exchangeably connected to the cross element 46. The width of the tools 2 determines the maximum cross-section Q to be forged, as shown by dotted lines in FIGS. 1 and 3. Smaller cross-sections, such as the square cross-section q indicated by solid lines or a rectangular cross-section shown in FIG. 1*a*, demand shifting of the cross elements 46 with the tools 2, so that the working surface of a given tool 2, in the unused width of the tool, overlaps with the lateral surface of an adjacent tool 2, the lateral offset V amounting to half the difference between the full tool width and the used tool width.

The setting of the tools 2 to a given cross-section i.e. to a given offset V must be accompanied by the setting of the rams or pistons 3 to the given cross-section value as an inner dimension of the stroke position which governs the approach of opposing tools 2. The drives 28 for the stroke position adjustment, and the drives by way of the worm shafts 60 for the lateral motion V of the cross elements 46 with the tools 2, are coupled to suitable transducers (not shown) to indicate the current setting of the stroke position and of the offset V (actual value). Reference value transducers can be used to effect automation with preset or pre-programmed reference values, also by way of process control computers, with inclusion of mutual interlocks for mutually exclusive operations and adjustments.

Figure 6:
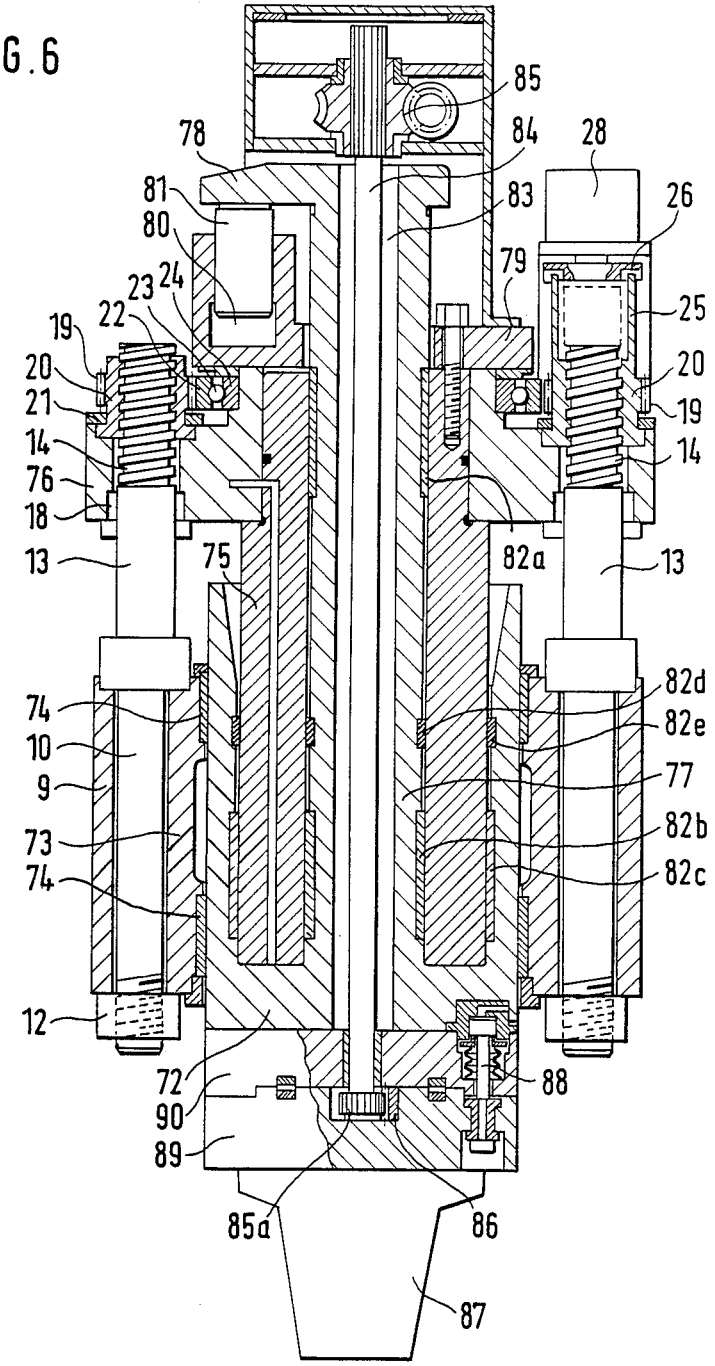
FIG. 6 shows a second embodiment in a cross-sectional view corrrespondng to that through the first embodiment shown in FIG. 2.

In the second embodiment the rams are in the form of cylinders 72, one of which is illustrated in FIG. 6. If the cylinders 72 are externally circular, they are guided in the machine frame 73 in guide sleeves 74; if they have flats and are therefore not externally circular, the sleeves 74 are replaced by suitably shaped guide plates. Each cylinder 72 forms a functional unit with a piston 75, the piston being supported on a yoke plate 76. The yoke plate 76 is adjusted relative to the machine frame 73 in the same way as the yoke plate 17 relative to the machine frame 5 in the first embodiment. Since equivalent components bear the same reference numerals, reference may be made to the description of the first embodiment.

The piston 75 is an annular piston, and the cylinder 72 is provided accordingly with a shank 77 which passes through the annular piston 75. At its outer end the shank 77 is provided with a transverse member 78. On the yoke plate 76 with the piston 75 a plate 79 is placed, containing cylindrical bores 80. Pistons 81 in the cylindrical bores 80 can be pressurized to return the cylinder 72, and the working stroke of the cylinder 72 is defined on the one hand by the annular piston 75 and on the other by the pistons 81. Between the annular piston 75 and the cylinder 72 and shank 77, there are guiding sleeves 82*a*, *b* and *c* and sealing rings 82*d* and *e*.

The piston 75, being annular, and the shank 77 permit tool adjustment through a bore 83 in the shank 77. To this end a shaft 84 is provided which can be rotated and held by way of a worm drive 85. A pinion 85*a* connected to the shaft 84 engages a rack 86 in the tool 87. By means of clamping devices 88 a cross element 89 bearing the tool 87 is fixed to a ram head member 90, the latter being connected to the cylinder 72. On release of the clamping devices 88, the tool 87 with its cross element 89 is adjustable on the head member 90 in the operating plane transversely relative to the ram axis.

Figure 7:
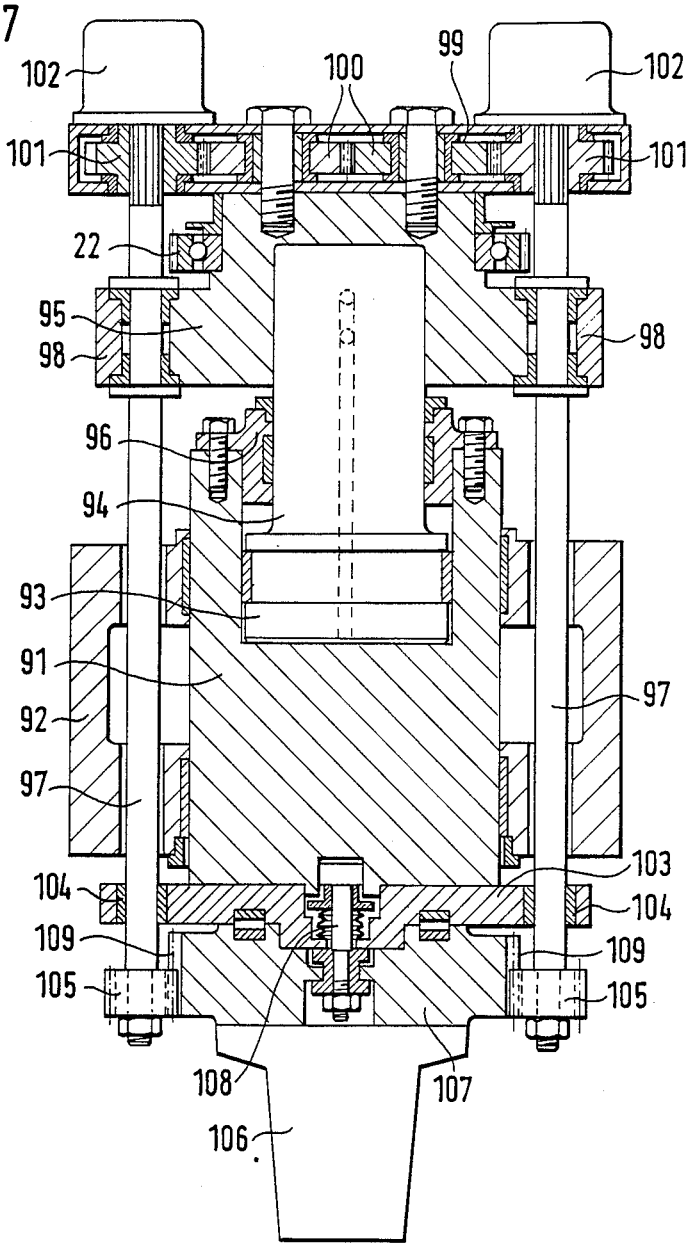
FIG. 7 shows a third embodiment in cross-sectional view along line D—D in FIG. 9.
Figure 8:
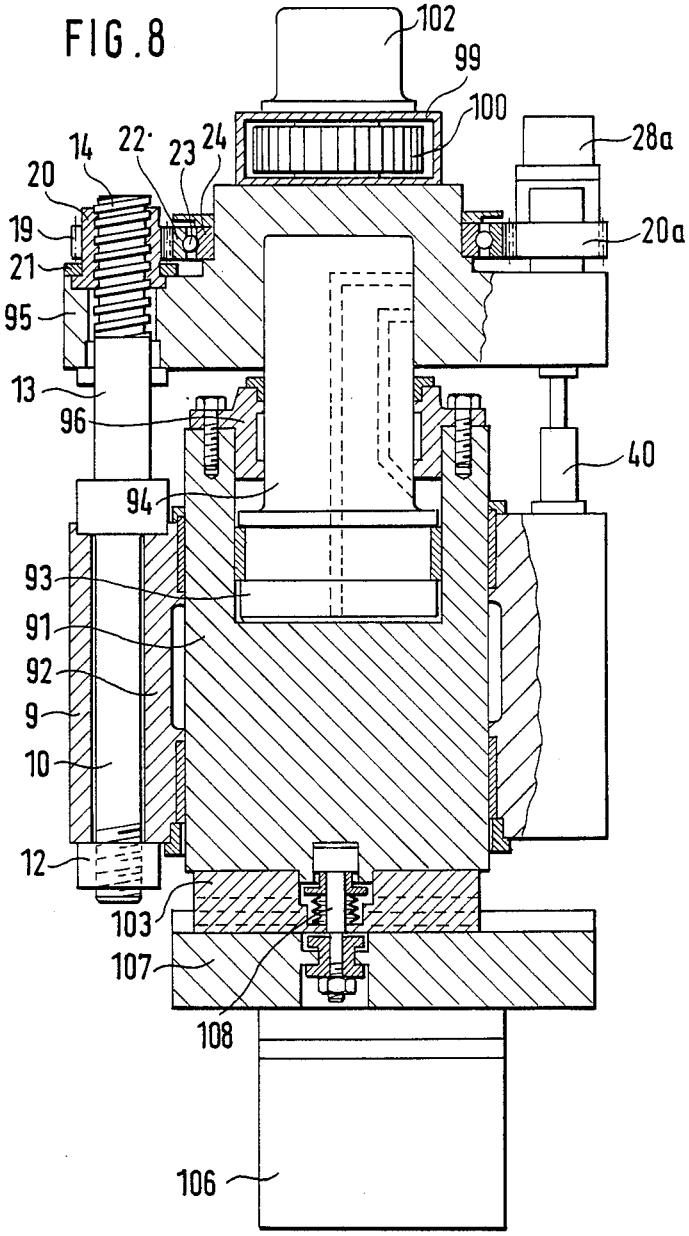
FIG. 8 shows the upper portion of the same embodiment as FIG. 7 in a cross-sectional view taken along line E—E in FIG. 9, and the tool area taken along line F—F in FIG. 9.
Figure 9:
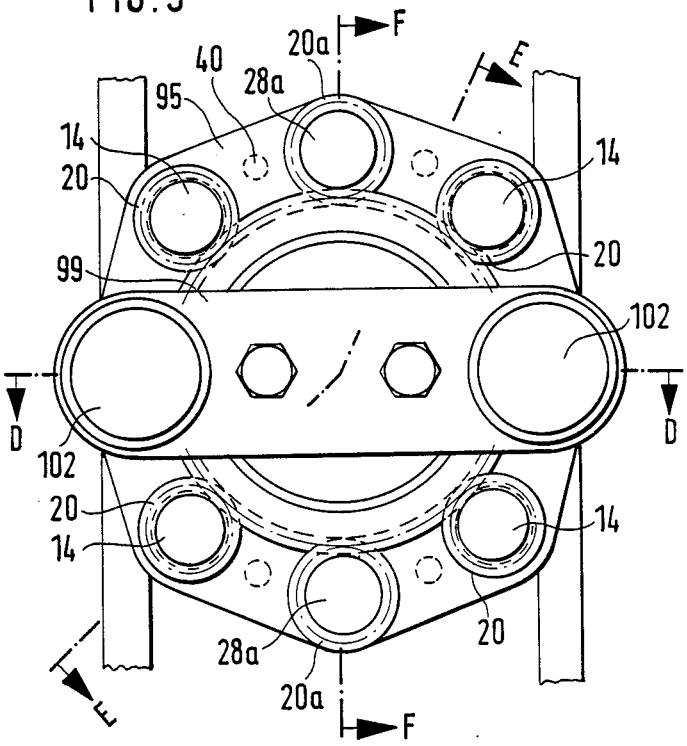
FIG. 9 is a plan view of the third embodiment.

In the third embodiment, as shown in FIGS. 7, 8 and 9, the rams are also in the form or cylinders 91. Each cylinder 91 is guided in the machine frame 92. In contrast to the second embodiment, the pistons 93, connected by piston rods 94 to the yoke plates 95, are double-acting. The rear end of each cylinder 91 is sealed round the piston rod 94 by a cover 96, which also limits the stroke of the cylinder 91 to the working stroke. The stroke position is adjusted by way of the yoke plate 95 in a similar manner to the first and second embodiments. Corresponding components bear the same reference numerals, and reference may be made to the description of the first and second embodiments, the ring gear 22 being drivable and holdable by motors 28*a* by way of pinions 20*a*.

Although the embodiment shown in FIGS. 7 to 9 could also have tool adjustment by way of a centrally mounted shaft, as in the first and second embodiments—for which purpose the piston 93 would be extended by a shank into a bore passing through the end of the cylinder 91, which would be sealed around the shank, this embodiment instead has tool adjustment by means of two external shafts 97 (FIG. 7), which are mounted in bearings 98 attached to the yoke plate 95 and which follow the motion of the yoke plate. On the yoke plate 95 there is a gear transmission 99 which, by way of two intermediate gears 100 and gears 101, provides a driving connection between the shafts 97, which the driven by motors 102. The shafts 97 are also mounted in a head member 103 associated with the cylinder 91 in sleeves 104 and connected to pinions 105. A cross element 107 carries the tool 106, is guided an the head member 103, and is releasably connected by a clamping device 108 to the head member 103; it is provided on both long sides with teeth 109 engaged by the pinions 105. On release of the clamping device 108, the tool 106 with its cross element 107 is adjustable on the head member 103 in the operating plane perpendicular to the ram axis, by means of pinions 105.

Figure 10:
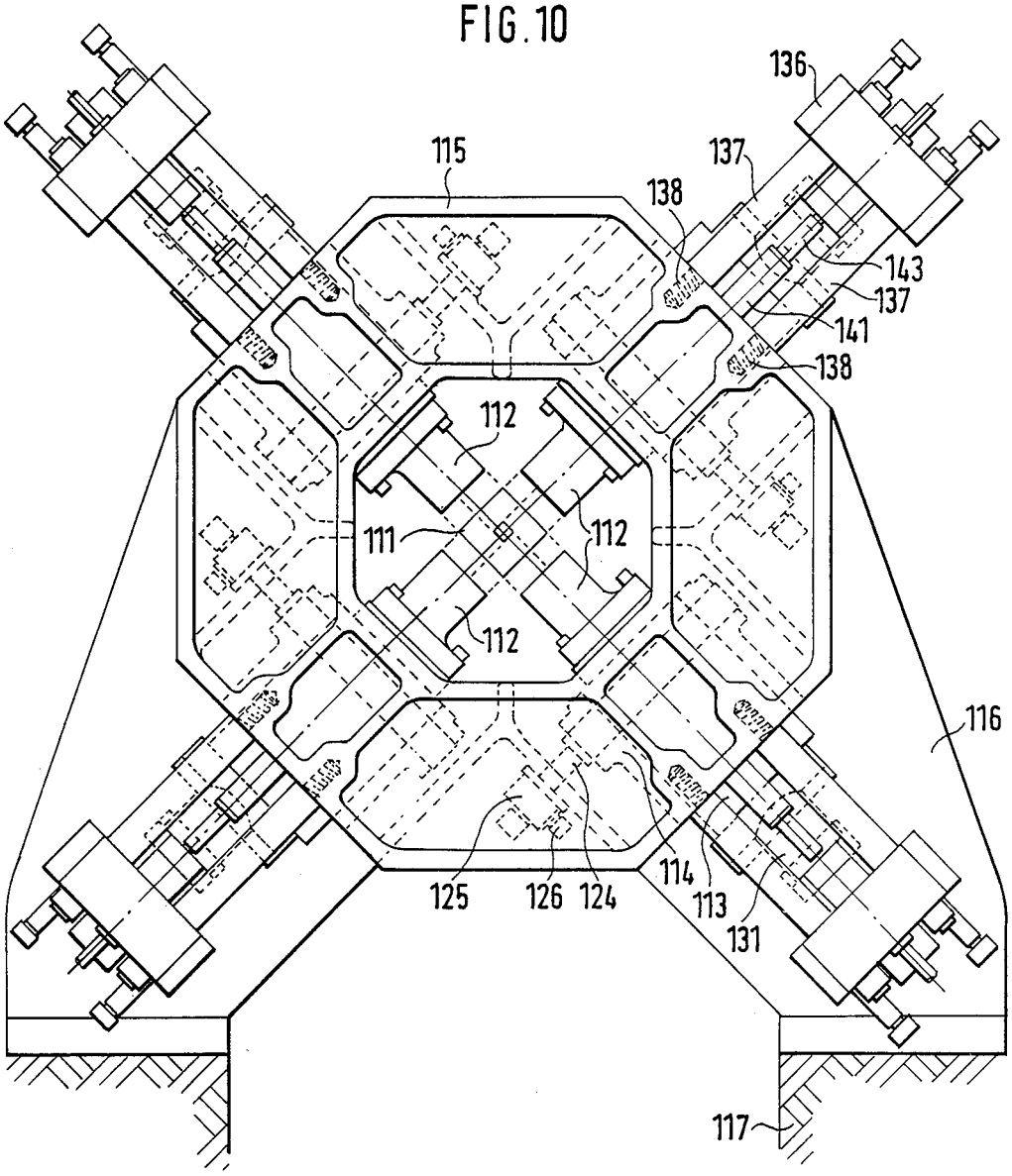
FIG. 10 is a view similar to FIG. 1 showing a fourth embodiment of the invention.
Figure 11:
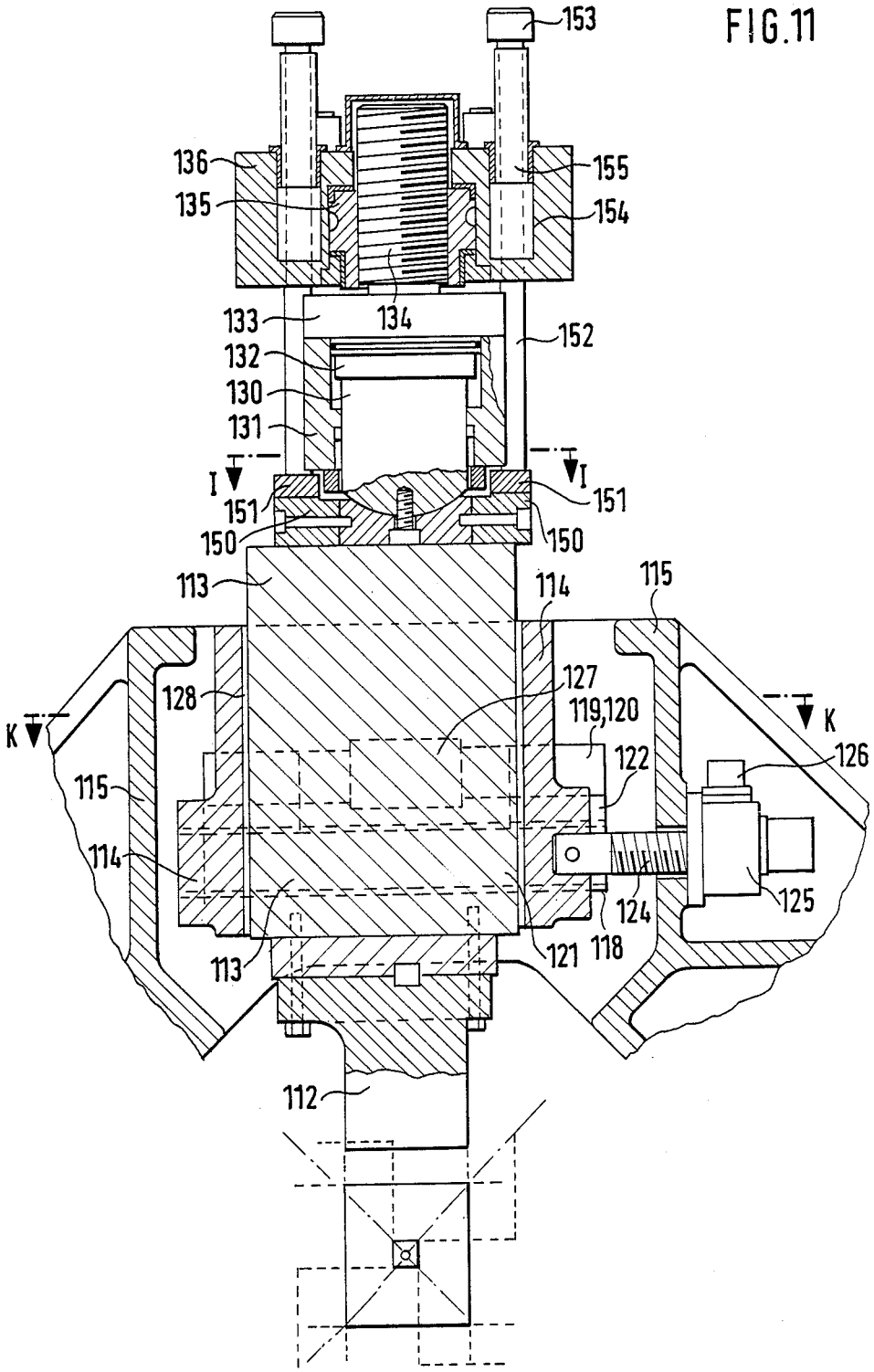
FIG. 11 is a cross-sectional view of the embodiment of FIG. 10 taken along line G—G in FIG. 13.

In the embodiment illustrated in FIGS. 10 to 15, the boundaries of the maximum and minimum cross-sections of a workpiece 111 to be forged are indicated in FIGS. 10 and 11. The tools 112 are shown as set for the maximum cross-section to be forged in their outer stroke end position, that is, in a fully open position, and also, by dotted lines, as set for the minimum cross-section to be forged, in their inner stroke end position, that is, with a closed workpiece space. The tools 112 are carried by rams 113 axially movable in cross elements 114, while the cross elements 114 in turn are movable in the operating plane perpendicular to the axis of the rams 113 in the machine frame 115. The frame 115 is anchored by feet 116 to the foundation 117.

To guide the cross elements 114 in the machine frame 115 the latter is provided with bars 118 and also with grooves 119 to receive closing members 120. The bars 118 and closing members together form guide grooves, in which slide the cross elements 114 with bars 121, fitted with rubbing plates. Wedges 122 are mounted between the bars 121 and the closing members 120. The wedges 122 are connected with spring-biased tie rods and clamp the cross elements 114 on their bars 121 in the guide grooves formed by the bars 118 and closing members 120, the wedges 122 being releasable against the action of the springs by piston/cylinder units 123 in order to enable the cross elements 114 to move. The cross elements 114 are moved by means of spindle drives comprising screw spindles 124 and driving transmissions 125 with drive motors 126, the transmissions 125 being formed by threaded nuts provided externally with worm teeth and rotated by worm shafts. To install the cross elements 114 in the machine frame 115, the closing members 120 and wedges 122 are removed, so that the cross elements 114 can be inserted from outside into the frame 115 and their bars 121 come to bear on the bars 119 in the frame 115. The wedges 122 and closing members 120 are then introduced into the grooves 119 through windows 127 in the frame 115.

Figure 12:
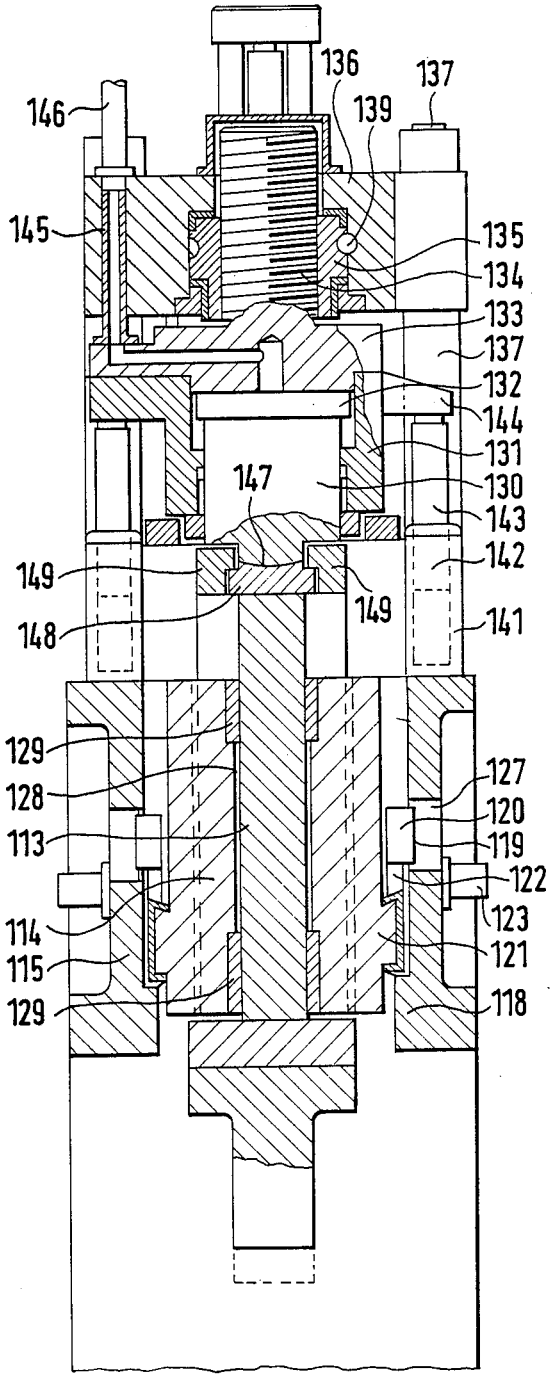
FIG. 12 is a cross-section view taken along line H—H in FIG. 13.
Figure 13:
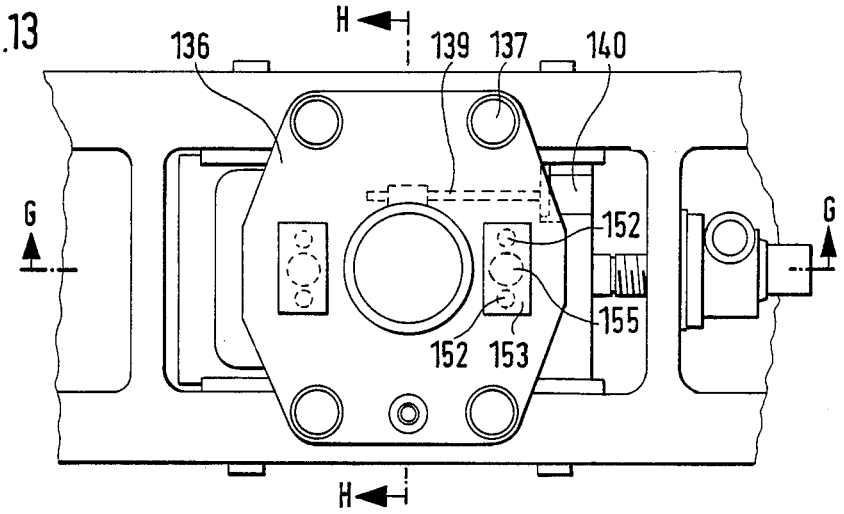
FIG. 13 is a top plan view of FIG. 11.
Figure 14:
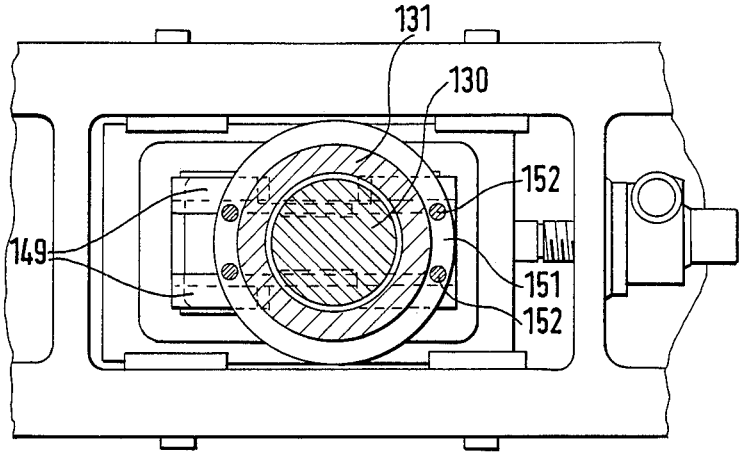
FIG. 14 is a cross-sectional view taken along line I—I in FIG. 11.
Figure 15:
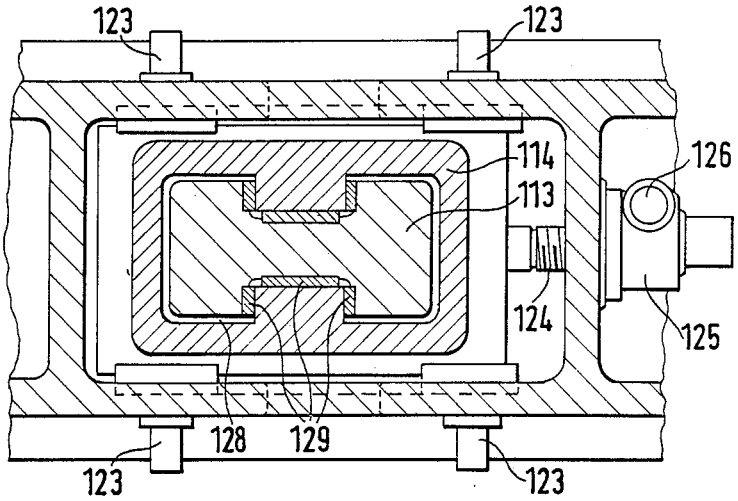
FIG. 15 is a cross-sectional view taken along line K—K in FIG. 11.

The rams 113 have I-shaped cross-sections and are axially movably guided in corresponding apertures 128 in the cross elements 114 by plates 129, as shown best in FIGS. 11, 12 and 15. The rams 113 are driven by pistons 130 slidable in cylinders 131. The piston 130 is provided with a collar 132 which mechanically limits the stroke of the piston 130 in the cylinder 131. Each cylinder 131 is closed by a cover 133 attached to it by screws. Each cover 133 is provided with a threaded pin 134 by which it is supported by way of a nut 135 in a transverse member 136. Tie rods 137, screwed by threaded pins 138 into bores in the machine frame 115, connect the transverse members 136 to the frame 115. The threaded nut 135 is in the form of a worm wheel, and the worm teeth are engaged by a worm on a worm shaft 139, which can be driven by a motor 140 for axial adjustment of the cylinder 131 with the piston 130, in order to adjust the stroke position of the associated tool 112. Also mounted in the machine frame 115 are cylinders 141 containing pistons 142, which with their piston rods 143, by way of projections 144 belonging to the cylinders 131, act on these, the cylinder covers 133 and the threaded pins 133, and keep the threaded pins 134 permanently abutting in the nuts 135, preventing any play. The piston 130 in the cylinder 131 can be pressurized by way of a sealed stab tube 145 and pipe 146, the tube 146 being fixed to the cylinder cover 133 and guided in the transverse member 136.

The pistons 130 are provided with spherical pressure surfaces 147, by means of which they press on the rams 113 by way of seats 148 also having spherical pressure surfaces. The adjustability of the cross elements 114 with the rams 113 in the operating plane perpendicular to the ram axis demands that the pistons 130 be coupled to the rams 113 in such a way as to balance this motion. The rams 113, to this end, are connected at their end faces to two respective bars 149, making a T-groove on the end face. In this T-groove are placed T-shaped slides 150, which are connected to a ring 151 and by way of the latter to tie rods 152. The tie rods 152 pass through the transverse member 136 and are connected above the transverse member 136 by yoke members 153. The transverse members 136 are provided with cylindrical bores 154 containing pistons 155, which act by way of the yoke members 153 on the tie rods 152. On pressurizing of the pistons 155 the T-shaped slides 150 in the T-grooves are clamped between the bars 149, so that the pistons 130 are connected to the rams 113. At the same time the pistons 155 act as return pistons for the pistons 130. If the cross elements 114 are to be adjusted with the rams 113, the motor 126 must be operated, and at the same time the pressurizing of the pistons 155 is interrupted.

In this embodiment, also, adjustment of the tools 112 to a given forging cross-section is accompanied by adjustment of the rams 113 with the pistons 130 and cylinders 131 to the corresponding stroke end position, by way of the motor 140. By way of the worm shaft 139, acting as transducer, the motion of the associated tool 112 can be determined as an actual value and set by means of reference value transducers.

We claim:

1. In a forging machine with four rams which are arranged in the form of a cross in an operating plane perpendicular to the longitudinal axis of the workpiece and are movable transversely relative to said axis along a radial ram axis and which are movable themselves as part of a piston/cylinder drive unit, and are operatively connected to tools which form a workpiece space in the stroke end position nearer the center of the cross, each tool having an unused width of its working surface overlapped by one side surface of one of the adjacent tools, and overlapping in turn with one of its side surfaces an unused width of the working surface of the other adjacent tool, the improvement wherein:

said drive units are arranged to act radially relative to the longitudinal axis of the workpiece;

stroke setting means are provided for each of said drive units for setting and indicating the stroke end position;

a cross element is provided on each ram forming a support means adjustable transversely to the respective radial ram axis;

each tool is supported on a respective cross element for adjustment transversely to the respective radial ram axis; and a setting device is provided operating in response to the stroke and position setting which determines the forging dimension for adjusting the tool transversely to said radial axis by an amount equal to half the difference between the total width of the tool working surface and the used width of said working surface of the tool for respective workpiece space.

2. A forging machine comprising:

a frame through which a workpiece is passed longitudinally along a workpiece axis;

four forging rams supported by said frame and arranged in the form of a cross in an operating plane perpendicular to said workpiece axis for radial ram movement along a radial ram axis substantially radial relative to said workpiece axis;

drive means for effecting said radial ram movement for forging a workpiece;

respective tools adjustably carried by said rams;

working surfaces on said respective tools which cooperatively and together in a forging position form a workpiece space bounded by operative portions of the widths of said respective tools dependent on the size of said workpiece space;

each tool in said forging position having a side surface which overlaps an unused inoperative portion of the width of said working surface of one of the adjacent tools, and having an unused inoperative portion of the width of said working surface thereof overlapped by said side surface of the other one of the adjacent tools;

a respective setting device for adjusting the position of each tool in the operating plane transversely off-center relative to said radial ram axis so that the widths of said operative portions of said tool working surfaces are adjusted to provide a workpiece space of selected size;

stroke setting means for setting the stroke end position of the ram stroke movement effected by said drive means; and means for operating each setting device in response to and dependent upon the setting for each stroke produced by said setting means.

3. A forging machine as claimed in claim 2 wherein: said setting means further comprises means for indicating the stroke end position of the ram stroke movement; and said setting device operating means is responsive to said indicating means.

4. The machine as claimed in claim 2 and further comprising for each ram: a cross element arranged and adapted to position said tool relative to said ram axis; and means for adjusting the position of said cross element transversely relative to said ram axis for thereby adjusting said position of said tool, said setting device acting on said cross element.

5. A forging machine as claimed in claim 4 wherein:

said cross element is adjustably guided in the machine frame for movement perpendicular to said ram axis; releasable clamping devices are provided for releasably clamping said cross-element against said movement:

said setting device is operatively connected to said cross-element for moving said cross element in the machine frame on release of said clamping devices and are arranged to act between the machine frame and said cross element; and said ram is axially movable in said cross element and connected to a respective ram drive means, said tool being mounted on said ram.

6. A forging machine as claimed in claim 5 wherein:

said drive means for each ram comprises piston/cylinder unit disposed substantially radially relative to said workpiece axis, the cylinder thereof being mounted static in the machine frame, and the piston thereof being connected to the respective ram by coupling means which balances the ram but transmits axial forces from said piston to said ram.

7. A forging machine as claimed in claim 6 wherein said coupling means provided between each piston and respective ram comprises:

a T-groove on the end face of the ram;

T-shaped slides running in said T-groove;

tie rods connected to said slides;

yoke members connected to said tie rods;

a transverse member operatively engaging said stroke setting means cylinder bores in said transverse member; and yoke pistons in said cylinder bores and connected to said yoke members so that pressurizing of said yoke pistons tensions said tie rods, said pressurizing being interrupted during operation of said setting devices for releasing said coupling means.

8. A forging machine as claimed in claim 2 wherein:

said drive means comprises: hydraulic drive means dimensioned only for the working stroke comprised of piston/cylinder units; and mechanical stroke limitation and mechanical setting means, comprising spindle drive means for setting said piston/cylinder units to define the stroke position and stroke end position according to the tool position determined by the workpiece space.

9. A forging machine as claimed in claim 4 and further comprising means for measuring transverse movements of said cross elements relative to said ram axis and for measuring stroke and positions of said rams, said transverse movements and stroke end positions being adjusted according to a workpiece space dimension process control computers.

10. A forging machine comprising:

a frame through which a workpiece is passed along a workpiece axis longitudinally;

four forging rams supported by said frame and arranged in the form of a cross in an operating plane perpendicular to said workpiece axis for radial ram movement relative to said workpiece axis;

ram drive means for effecting said radial ram movement for forging a workpiece;

a head member provided on each ram;

a cross element guided on each head member for movement transversely relative to said radial ram movement;

a forging tool on each cross-element;

working surfaces on said tools which cooperatively together in a forging position form a workpiece space bounded by operative portions of the widths of said respective tools dependent on the size of said workpiece space;

each tool in said forging position having a side surface which overlaps an unused inoperative portion of the width of said working surface of one of the adjacent tools, and having an unused inoperative portion of the width of said working surface thereof overlapped by said side surface of the other one of the adjacent tools;

a setting device arranged to act between each cross element and respective head member and acting on each cross element for adjusting the position of each cross-element relative to the respective head member thereby adjusting the position of each tool in the operating plane transversely off-center relative to the respective radial ram movement so that the widths of said operative portions of said tool working surfaces are adjusted to provide a workpiece space of selected size; and releasable clamping elements operatively associated with each cross element and respective head member for releasably clamping each cross element to the respective head member in positions selected by operation of said setting devices.

11. The machine as claimed in claim 10 and further comprising for each ram:

an end on said ram remote from said head member thereof;

setting device drive means for actuating the respective setting device mounted at said end of the ram remote from said head member; and coupling means between said setting device drive means and setting device, extending in the direction of movement of said ram.

12. The machine as claimed in claim 11 and further comprising for each ram: indicating device means for actuating the respective setting device mounted at said end of said ram remote from said head member.

13. A forging machine as claimed in claim 10 and further comprising for each ram:

a ram cylinder connected to said frame, said ram being in the form of a ram piston slidable in said ram cylinder and projecting from one end thereof, so that said ram piston and ram cylinder form said drive means for said ram; and a plug forming the other end of said cylinder, said plug being adjustable axially in said cylinder for adjusting the stroke position of said ram.

14. A forging machine as claimed in claim 13 wherein:

each piston is provided with a shank;

each plug is provided with an axial bore; and said shank passes though said bore.

15. A forging machine as claimed in claim 10 wherein: each ram is in the form of a cylinder;

for each ram a piston is mounted on the machine frame;

said cylinder is slidable on said piston so that said cylinder and piston together form said drive means for said ram movement; and each piston is mounted on the machine frame in axially adjustable manner for adjusting the stroke position of said ram.

16. The forging machine as claimed in claim 15 wherein:

each cylinder has an annular cross section and is provided with an internal axial shank;

each piston has an annular cross section with an axial bore; and said shank passes through a respective bore.

17. A forging machine as claimed in claim 14 and further comprising for each ram:

an end on said ram remote for said head member;

setting device drive means for actuating the respective setting device mounted at an end of said ram remote from said head member;

coupling means between said setting device drive means and setting device extending in the direction of movement of said ram; and an axial borre in each shank, each coupling means being accommodated in a respective one of said bores.

18. A forging machine as claimed in claim 17 and further comprising for each ram;

indicating device means for actuating the respective setting device.

19. The forging machine as claimed in claim 11 wherein each setting device comprises:

a rack provided on the respective cross element;

a pinion in mesh with said rack; and a pinion shaft connected to said pinion for rotating said pinion.

20. A forging machine as claimed in claim 10 and further comprising:

toothing provided on each cross element; and toothing provided on each head member releasably engageable with said toothing on a respective cross-element for positively interconnecting said cross element and head member when said clamping elements are in the clamping position and preventing relative motion of said cross element and head member.

21. The forging machine as claimed in claim 20 and further comprising:

respective bars provided with said toothings; and grooves provided respectively in said head members and cross elements for accommodating said bars.

22. The forging machine as claimed in claim 10 wherein said clamping elements comprise:

at least one pin;

collars on said at least one pin gripping a respective cross element and head member; and a spring means resiliently urging said cross-element and head member into the clamping position;

one of said collars being in the form of a piston means positioned relative to said spring means and operating in a cylinder so that pressure on said piston means moves said piston means against the force of said spring means to release the clamping action thereof, pressurizing of said piston means and release of said clamping action simultaneously facilitating operation of a respective setting device.

23. A forging machine as claimed in claim 22, wherein:

said release of said clamping action by pressurizing of said piston means moves said respective cross-member and head member relatively producing a resulting gap therebetween and;

a valve means is provided operable by said pressurizing of said piston to open and allow compressed air to pass through said gap between the cross element and head member to prevent dirt from entering said gap.

* * * * *